United States Patent [19]

Yunoki

[11] Patent Number: 4,782,587

[45] Date of Patent: Nov. 8, 1988

[54] SLIDER HOLDING APPARATUS

[75] Inventor: Akio Yunoki, Namerikawa, Japan

[73] Assignee: Yoshida Kogyo K. K., Tokyo, Japan

[21] Appl. No.: 66,061

[22] Filed: Jun. 24, 1987

[30] Foreign Application Priority Data

Jun. 25, 1986 [JP] Japan ..... 61-148682

[51] Int. Cl.[4] ..... A41H 37/06

[52] U.S. Cl. ..... 29/768; 269/49; 269/229; 269/909

[58] Field of Search ..... 29/766, 767, 768, 769, 29/770, 408, 409, 410; 269/909, 329, 229, 47, 49

[56] References Cited

U.S. PATENT DOCUMENTS

| | | | |
|---|---|---|---|
| 3,685,814 | 8/1972 | Kawakami | 269/49 |
| 3,792,521 | 2/1974 | Kawakami | 29/207.5 R |
| 3,812,571 | 5/1974 | Dori | 29/768 X |
| 3,844,014 | 10/1974 | Takahashi et al. | 29/768 X |
| 3,844,016 | 10/1974 | Kawakami | 29/207.5 SL |
| 3,902,235 | 9/1975 | Kawakami et al. | 29/207.5 SL |
| 3,945,103 | 3/1976 | Fujisaki et al. | 29/768 |
| 3,956,813 | 5/1976 | Shigeno | 29/768 |
| 4,049,155 | 9/1977 | Kawakami et al. | 221/192 |
| 4,355,461 | 10/1982 | Doori | 29/768 |
| 4,397,454 | 8/1983 | Nakagawa | 29/768 X |
| 4,437,233 | 3/1984 | Yoshieda et al. | 29/768 |
| 4,466,168 | 8/1984 | Hatagishi | 29/409 |
| 4,520,560 | 6/1985 | Nakagawa | 29/768 |
| 4,573,264 | 3/1986 | Hatagishi | 29/766 |
| 4,625,398 | 12/1986 | Kando | 29/768 |

FOREIGN PATENT DOCUMENTS

| | | |
|---|---|---|
| 141280 | 5/1985 | European Pat. Off. . |
| 2255868 | 7/1975 | France . |
| 512026 | 1/1976 | Japan . |
| 52-28057 | 7/1977 | Japan . |
| 52-38325 | 8/1977 | Japan . |
| 57-42324 | 9/1982 | Japan . |
| 59-42905 | 12/1984 | Japan . |

*Primary Examiner*—Howard N. Goldberg
*Assistant Examiner*—Joseph M. Gorski
*Attorney, Agent, or Firm*—Hill, Van Santen, Steadman & Simpson

[57] ABSTRACT

An apparatus for holding a slider includes a holder body defining a space for receiving a pull tab, and a slider support having a first seat and a bore below the first seat. A locking lever is pivotally disposed in the space and has a locking projection. A supporting arm is angularly movable between an inclined position in which its second seat is positioned remotely from the first seat and it presses the locking lever so that the projection is retracted into the bore, and an upright position in which the second seat is positioned adjacent to the first seat. As the arm is angularly moved from the inclined position to the upright position, the locking lever is allowed to turn so that the projection projects through the bore for engagement with the slider's pull tab.

7 Claims, 3 Drawing Sheets

SLIDER HOLDING APPARATUS

This application is related to my copending application, U.S. Ser. No. 07/066,064.

BACKGROUND OF THE INVENTION

1. Field of the Invention

The present invention relates to an apparatus for holding a slider during the threading of a slide fastener chain through the slider in the manufacture of a slide fastener.

2. Description of Prior Art

Most of slide fastener sliders include a slider body and a pull tab pivotally connected to the slider body and having an aperture. Various apparatus are known which automatically hold such a slider upside down for threading therethrough of a slide fastener chain in the manufacture of a slide fastener.

A prior art apparatus as disclosed in U.S. Pat. No. 3,902,235, issued Sept. 2, 1987 includes a vertically movable holder body having at its upper end a slider seat with an upwardly opening slit and a spring-biased pivotable lever having a locking projection. To hold a slider, the holder body is moved upwardly toward the slider until the slider's pull tab is longitudinally received in the slit and then the slider body is supported on the slider seat, in response to which the lever is actuated to turn so that the locking projection projects into the slit for engagement with the edge of the aperture in the pull tab.

Another prior art apparatus as disclosed in U.S. Pat. No. 4,437,233, issued Mar. 20, 1984 includes a holder body having at its upper end a slider seat and defining adjacent to the slider seat an upwardly opening space that is also opening toward a slider chute. A slider is fed from the chute horizontally to the apparatus until the slider body is supported on the slider seat, during which time the pull tab hanging from the slider body is introduced into the space and is then engaged by a locking projection of a spring-biased pivotable lever.

However, these prior art apparatus have the following disadvantages due to the fact that the pull tab is subject to objectionable vibration during operation: With the first-mentioned apparatus, the slider seat frequently fails to receive the pull tab in the slit, so that the slider can inevitably fall off the seat as the holder body is moved upwardly. With the second-mentioned apparatus, the locking projection of the lever tends to inadequately engage the edge of the aperture in the pull tab, and hence firm holding of the slider is difficult to achieve. As a result, the slider can be easily detached from the holder body during the threading of a slide fastener chain through the slider.

SUMMARY OF THE INVENTION

It is therefore an object of the present invention to provide an apparatus which is simple in construction and can automatically hold a slider in position easily with adequate firmness.

According to the present invention, an apparatus for holding a slider comprises: a holder body defining a space for receiving the slider's pull tab as the slider is supplied to the apparatus; a slider support disposed across the space and having at an upper end a first seat for supporting thereon one half portion of the slider body and also having a bore below the first seat; a supporting arm pivotally disposed in the space rearwardly of the slider support and having at one end a second seat for supporting thereon the other half portion of the slider body; and a locking lever pivotally disposed in the space forwardly of the slider support and having at an upper end portion a locking projection, the lever being normally urged by spring means in a direction in which the locking projection projects through the bore of the slider support. The supporting arm is angularly movable between an inclined position in which the second seat is positioned remotely from the first seat and the other end of the supporting arm presses the locking lever against the bias of the spring means so that the locking projection is retracted into the bore, and an upright position in which the second seat is positioned adjacent to and in horizontal alignment with the first seat for cooperating with the latter in supporting the slider body with the pull tab held between the slider support and supporting arm. As the supporting arm is angularly moved from the inclined position to the upright position, the locking lever is allowed to turn under the bias of the spring so that the locking projection projects into engagement with an edge of an aperture in the pull tab.

Many other objects, advantages and additional features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
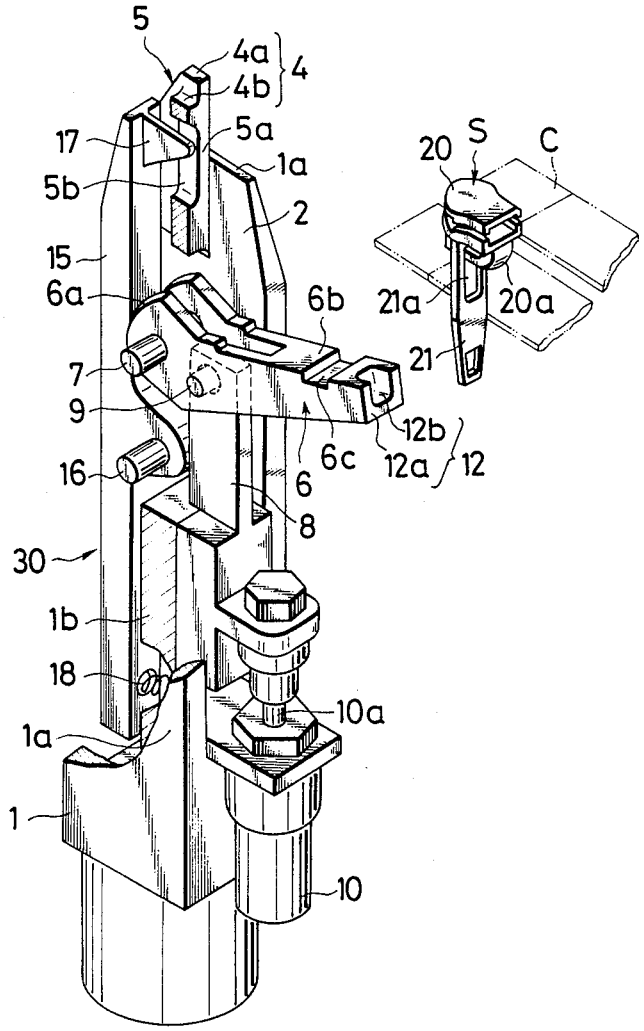
FIG. 1 is a perspective view, with parts broken away, of an apparatus according to the present invention.

FIG. 1 shows an apparatus 30 for holding a slider S in position during the threading of a slide fastener chain F (FIGS. 3, 4 and 6) through the slider S. The slider S includes a slider body 20 having on its upper wing a lug 20*a*, and a pull tab 21 pivotally connected to the lug 20*a*. The pull tab 21 has an aperture 21*a*. The slider S is supplied upside down from a slider chute C to the apparatus 30 along a horizontal feed path, with the pull tab 21 hanging from the lug 20*a*.

The apparatus 30 generally comprises a holder body 1, a supporting arm 6, and a locking lever 15.

The holder body 1 includes a pair of confronting vertical walls 1*a*, 1*a* spaced transversely of the slider feed path so as to define a space 2 opening upwardly and rearwardly (toward the chute C) for receiving the pull tab 21 as the slider S is supplied to the apparatus 30. The holder body 1 has a slider support 5 secured at opposite sides to upper inner surfaces of the vertical walls 1*a*, 1*a* and extending across the space 2, the slider support 5 having an upper portion projecting upwardly beyond the walls 1*a*, 1*a*.

At the upper end of the slider support 5, a first seat 4 is provided which includes a pair of side ledges 4*a*, 4*a* (only one shown in FIG. 1) spaced from each other transversely of the slider feed path, and a recess 4*b* between the ledges 4*a*, 4*a*. The slider support 5 also has a vertical rear surface 5*a* engageable with one (front) surface of the slider pull tab 21, and a vertically elongated horizontal bore 5*b* below the recess 4*b* for a purpose hereinafter described.

The supporting arm 6 is disposed in the space 2 rearwardly of the slider support 5 and is pivotally connected at one end to the vertical walls 1*a*, 1*a* by a first pin 7 located below the slider support 5. The arm 6 is also connected to an actuator bar 8 by a second pin 9 slightly spaced from the first pin 7 toward the other end of the arm 6. The actuator bar 8 is disposed between the vertical walls 1*a*, 1*a* and is operatively connected to a piston rod 10*a* of an air cylinder 10 for longitudinal movement along the walls 1*a*, 1*a*. The arm 6 is thus angularly movable about the first pin 7 between an inclined position of FIGS. 1 and 2 and an upright position of FIG. 3. The one end of the arm 6 has a cam surface 6*a*.

At the other end of the supporting arm 6, a second seat 12 is provided which includes a substantially U-shaped (as viewed from the right in FIG. 1) ledge 12*a* and a recess 12*b* defined by the ledge 12*a*. The arm 6 also has a front (upper in FIG. 1) surface 6*b* and a transverse slot 6*c* between the front surface 6*b* and the ledge 12*a*.

The locking lever 15 is disposed in the space 2 forwardly of the slider support 5 and is pivotally connected at an enlarged central portion to the vertical walls 1*a*, 1*a* by a third pin 16 located below the first pin 7. The cam surface 6*a* of the supporting arm 6 is slidably engageable with a rear surface of the lever 15 above the third pin 16. At the upper end of the lever 15, there is defined a rearwardly directed locking projection 17. A compression spring 18 acts between the lower end of the lever 15 and a central post 1*b* of the holder body 1 to normally urge the lever 15 clockwise (FIGS. 2 and 3) or in a direction in which the projection 17 projects through the bore 5*b* of the slider support 5 into the space 2.

The operation of the apparatus 30 will now be described with reference to FIGS. 2 through 4.

Figure 2:
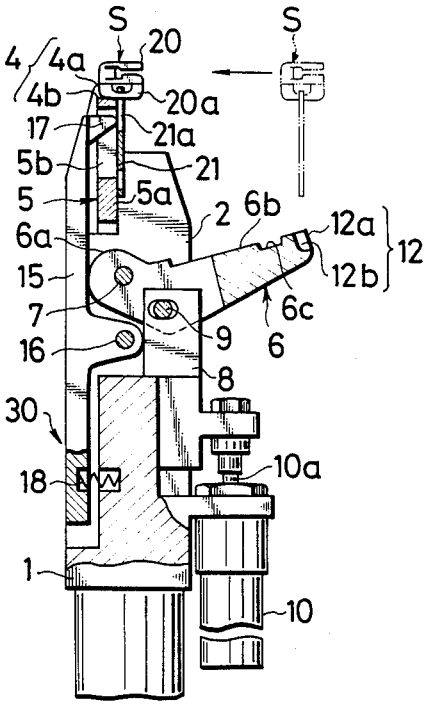
FIGS. 2 and 3 side elevational views, with parts in cross section, of the apparatus, illustrating the manner in which a slider is held on the apparatus.

The slider S is fed along the feed path to the apparatus 30 until one (front) half portion of the slider body 20 is supported on the first seat 4 with one half portion of the lug 20*a* received in the recess 4*b*, as shown in FIG. 2, during which time the pull tab 21 hanging from the slider body 20 is introduced through the space 2 to abut against the vertical rear surface 5*a* of the slider support 5 with the aperture 21*a* communicating with the bore 5*b*. At that time, the slider supporting arm 6 is in the inclined position in which the second seat 12 is positioned remotely from the first seat 4 of the slider support 5, and the cam surface 6*a* presses the locking lever 15 against the bias of the spring 18 so that the projection 17 is retracted into the bore 5*b*. Then, the piston rod 10*a* of the air cylinder 10 is extended to move the actuating bar 8 upwardly, thereby causing the arm 6 to angularly move about the first pin 7 toward the upright position (FIG. 3) in which the second seat 12 is positioned adjacent to and in horizontal alignment with the first seat 4. As a result, the other half portion of the slider body 20 is supported on the second seat 12 with the other half portion of the lug 20*a* received in the recess 12*a*. The slider body 20 is supported on the first and second seats 4, 12, with the pull tab 21 held against oscillations between the rear surface 5*a* of the slider support 5 and the front surface 6*b* of the supporting arm 6. As the supporting arm 6 is angularly moved from the inclined position to the upright position, the lever 15 is allowed to turn clockwise under the bias of the spring 18 so that the locking projection 17 projects through the bore 5*b* into engagement with the edge of the aperture 21*a* of the slider pull tab 21, thus causing the tip of the locking projection 17 to be received in the transverse slot 6*c* of the supporting arm 6. The slider S is thus firmly held on the apparatus 30 in position for threading therethrough of the slide fastener chain F, as shown in FIG. 4.

Figure 3:
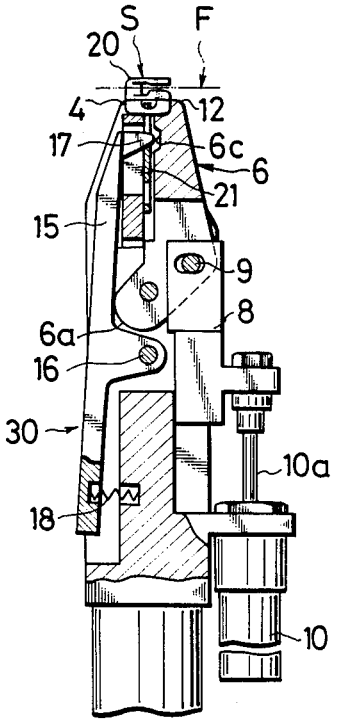
Figure 4:
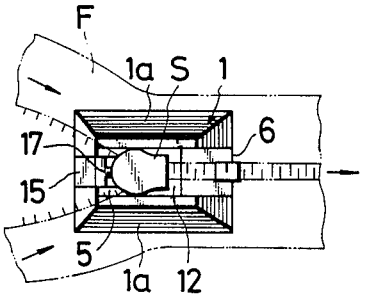
FIG. 4 is a plan view of the apparatus, showing the manner in which a slide fastener chain is threaded through the slider held on the apparatus.
Figure 5:
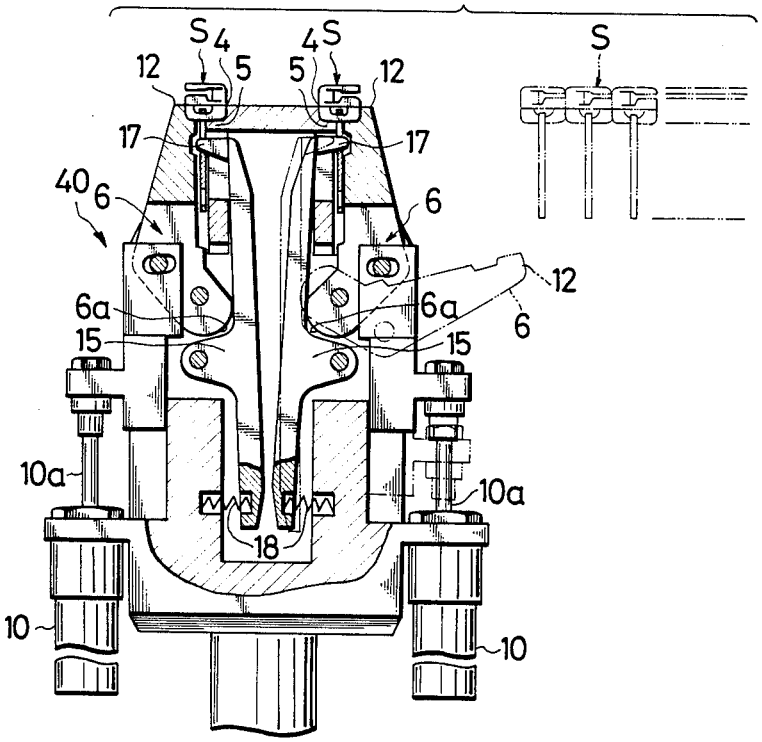
FIG. 5 is a side elevational view, with parts in cross section, of a modified apparatus according to the invention.

FIG. 5 shows a modified apparatus 40 which is different from the apparatus 30 of FIGS. 1 through 3 in that for holding two sliders S, S at a time, it includes a pair of interconnected slider supports 5, 5 each having at its upper end a first seat 4. The apparatus 40 also has a pair of horizontally oppositely directed supporting arms 6, 6 disposed outwardly of the pair of the slider supports 5, 5, each of said arms 6, 6 having at one end a second seat 12. Further, a pair of horizontally oppositely directed locking levers 15, 15 is disposed inwardly of the pair of the slider supports 5, 5. Thus the individual double parts are disposed in a mirror-image relationship.

Figure 6:
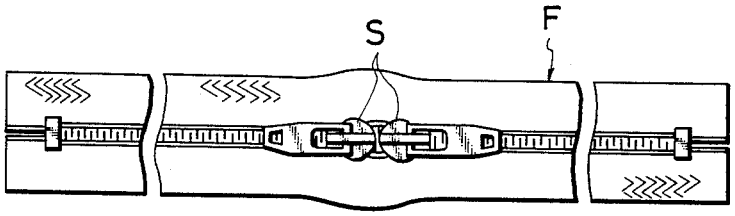
FIG. 6 is a plan view of a pair of stringers of a slide fastener chain threaded through two sliders by the modified apparatus shown in FIG. 5.

FIG. 6 shows a pair of stringers of a slide fastener chain F, to which two sliders S, S are mounted by the apparatus 40 to provide a bidirectionally openable slide fastener that is suitably used such as in a suitcase.

With the apparatus described above, because the slider pull tab is locked without fail during the angular movement of the supporting arm from the inclined position to the upright position, a slider can be held in position easily with adequate firmness so as not to be detached from the apparatus during threading therethrough of a slide fastener chain.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for holding a slider in position during the threading of a slide fastener chain through the slider, the slider including a pull tab pivotally connected to a slider body and having an aperture, the slider being supplied toward said apparatus, said apparatus comprising:

(a) a holder body defining a space opening upwardly and rearwardly for receiving the pull tab as the slider is supplied to the apparatus;

(b) a slider support disposed across said space and having at an upper end a first seat for supporting thereon one half portion of the slider body, and also having a bore below said first seat;

(c) a supporting arm having two ends, said supporting arm being pivotally disposed in said space rearwardly of the slider support and having at one end a second seat or supporting thereon the other half portion of the slider body;

(d) a locking lever pivotally disposed in said space forwardly of the slider support and having a locking projection, said lever being normally urged by spring means in a direction in which said locking projection projects through said bore of the slider support; and (e) means for angularly moving said supporting arm from an inclined position in which said second seat is positioned remotely from said first seat and the other end of the supporting arm presses said locking lever against the bias of the spring means such that said locking projection is retracted into the bore, to an upright position in which said second seat is positioned adjacent to and in horizontal alignment with said first seat for cooperating with said first seat in supporting the slider body with the pull tab being held between said slider support and supporting arm; so that (f) as said supporting arm is angularly moved from the inclined position to the upright position, said locking lever turns under the bias of said spring means, so that said locking projection projects into engagement with an edge of the aperture in the pull tab.

2. An apparatus according to claim 1, said other end of said supporting arm having a cam surface.

3. An apparatus according to claim 1, said means for moving said supporting arm comprising an actuator bar connected to said supporting arm, and also connected to a piston rod of an air cylinder.

4. An apparatus according to claim 1 wherein the locking projection contacts the bottom edge of the aperture in the pull tab to urge it downwardly.

5. An apparatus for holding a slider in position during the threading of a slide fastener chain through the slider, the slider including a pull tab pivotally connected to a slider body and having an aperture, the slider being supplied upside down toward said apparatus, said apparatus comprising:

(a) a holder body defining a space for receiving the pull tab as the slider is supplied to the apparatus;

(b) a pair of interconnected slider supports each having at its upper end a first seat for supporting thereon one half portion of the slider body, and also having a bore below each first seat;

(c) a pair of horizontally oppositely directed supporting arms each having two ends, and each being pivotally disposed in said space outwardly of its corresponding slider support, each of said arms having at one end a second seat for supporting thereon the other half portion of the slider body;

(d) a pair of horizontally oppositely directed locking levers each being pivotally disposed in said space inwardly of its corresponding slider support, each of said levers having a locking projection and being normally biased by spring means in a direction in which each locking projection projects through the bore of its corresponding slider support;

(e) means for angularly moving each of said supporting arms from an inclined position in which each second seat is positioned remotely from the first seat of its corresponding slider support and the other end of each supporting arm presses its corresponding locking lever against the bias of the spring means so that each locking projection is retracted into its corresponding bore, to an upright position in which each second seat is positioned adjacent to and in horizontal alignment with said first seat of its corresponding slider support for cooperating with its corresponding first seat in supporting a slider body with the pull tab held between its corresponding slider support and supporting arm; so that (f) as each supporting arm is angularly moved from the inclined position to the upright position, its corresponding locking lever turns under the bias of its corresponding spring means so that each locking projection projects into engagement with an edge of the aperture in its corresponding pull tab.

6. An apparatus according to claim 4, said other end of each of the supporting arms having a cam surface.

7. An apparatus according to claim 4 wherein each locking projection contacts the bottom edge of the aperture in its corresponding pull tab to urge it downwardly.

* * * * *